US012650061B2

(12) United States Patent
El Mallawany et al.

(10) Patent No.: US 12,650,061 B2
(45) Date of Patent: Jun. 9, 2026

(54) FLOW CONTROL DEVICE WITH WASHPIPE FREE FEATURE IN ONE HOUSING

(71) Applicant: Halliburton Energy Services, Inc., Houston, TX (US)

(72) Inventors: Ibrahim El Mallawany, Al-Khobar (SA); Luis Herrera-Cruz, Carrollton, TX (US); Stephen Michael Greci, Carrollton, TX (US); Ryan M. Novelen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/602,376

(22) Filed: Mar. 12, 2024

(65) Prior Publication Data

US 2024/0392651 A1 Nov. 28, 2024

Related U.S. Application Data

(60) Provisional application No. 63/468,205, filed on May 22, 2023.

(51) Int. Cl.

| | |
|---|---|
| ***E21B 43/08*** | (2006.01) |
| ***E21B 34/14*** | (2006.01) |
| ***E21B 41/00*** | (2006.01) |

(52) U.S. Cl.

CPC ..... *E21B 43/08* (2013.01); *E21B 34/142* (2020.05); *E21B 41/0078* (2013.01); *E21B 2200/04* (2020.05); *E21B 2200/06* (2020.05)

(58) Field of Classification Search

CPC .... E21B 43/08; E21B 34/142; E21B 41/0078; E21B 2200/06; E21B 2200/04

See application file for complete search history.

(56) References Cited

U.S. PATENT DOCUMENTS 4,324,293 A * 4/1982 Hushbeck ..... E21B 49/001 166/324

7,201,232 B2 4/2007 Turner et al.

(Continued)

OTHER PUBLICATIONS

International Search Report and Written Opinion for International Patent Application No. PCT/US2024/022661 dated Jul. 22, 2024. PDF file. 11 pages.

(Continued)

*Primary Examiner* — Neel Girish Patel

(74) *Attorney, Agent, or Firm* — Scott Richardson; C. Tumey Law Group PLLC

(57) ABSTRACT

A downhole system may include a housing disposed about a downhole tubular. The housing has a nozzle chamber in fluid communication with an annulus of a wellbore. The downhole system further includes a flow control device nozzle disposed within the nozzle chamber and configured to control a fluid flow rate through the nozzle chamber. The downhole system includes a ball disposed within the nozzle chamber. The ball is moveable to plug the nozzle chamber in response to fluid flow from the central bore of the downhole tubular toward the annulus. Additionally, the downhole system includes a piston chamber in fluid communication with the nozzle chamber and a central bore of a downhole tubular. Further, the downhole system includes a piston that is slidable within the piston chamber between a run-in position and an open position. The piston blocks the ball from traversing into the piston chamber in the run-in position.

17 Claims, 5 Drawing Sheets

(56) References Cited

U.S. PATENT DOCUMENTS

| | | | | |
|---|---|---|---|---|
| 7,775,283 | B2 | 8/2010 | Coronado et al. | |
| 8,485,225 | B2 * | 7/2013 | Veit | E21B 34/102 166/227 |
| 8,807,215 | B2 | 8/2014 | Holderman et al. | |
| 9,206,669 | B2 | 12/2015 | Holderman | |
| 11,041,360 | B2 | 6/2021 | Penno et al. | |
| 11,066,909 | B2 | 7/2021 | Mn et al. | |
| 2009/0151925 | A1 | 6/2009 | Richards et al. | |
| 2011/0100643 | A1 * | 5/2011 | Themig | E21B 34/10 166/321 |
| 2011/0198097 | A1 * | 8/2011 | Moen | E21B 34/08 166/324 |
| 2011/0303420 | A1 * | 12/2011 | Thorkildsen | E21B 34/063 166/205 |
| 2013/0000740 | A1 * | 1/2013 | Veit | E21B 34/102 137/12 |
| 2013/0056220 | A1 | 3/2013 | Sommers et al. | |
| 2013/0284452 | A1 * | 10/2013 | Franklin | E21B 43/12 166/205 |
| 2014/0034308 | A1 * | 2/2014 | Holderman | E21B 34/142 166/279 |
| 2014/0060803 | A1 * | 3/2014 | Gano | E21B 34/066 166/66.5 |
| 2014/0246208 | A1 | 9/2014 | Themig et al. | |
| 2014/0246209 | A1 | 9/2014 | Themig et al. | |
| 2018/0334882 | A1 * | 11/2018 | Brandsdal | E21B 34/063 |
| 2018/0363420 | A1 | 12/2018 | Ross et al. | |
| 2019/0151925 | A1 | 5/2019 | Lerch et al. | |
| 2021/0324715 | A1 * | 10/2021 | Yin | E21B 33/12 |
| 2024/0117718 | A1 * | 4/2024 | El Mallawany | E21B 34/10 |

OTHER PUBLICATIONS

United States Patent Office U.S. Appl. No. 19/010,421, filed Jan. 6, 2025.

* cited by examiner

FLOW CONTROL DEVICE WITH WASHPIPE FREE FEATURE IN ONE HOUSING

CROSS-REFERENCE TO RELATED APPLICATIONS

The present application is a non-provisional conversion of U.S. Provisional Application Ser. No. 63/468,205, filed on May 22, 2023, which is herein incorporated by reference in its entirety.

BACKGROUND

In the process of completing an oil or gas well, a tubular is run downhole into a wellbore and used to direct produced hydrocarbon fluids from a downhole formation to the surface. Typically, this tubular is coupled to a flow regulating system that has a screen assembly that controls and limits debris, such as gravel, sand, and other particulate matter, from entering the tubular as the fluid passes through the screen assembly. The flow regulating system generally also includes a flow control device that controls fluid flow into the tubular from the wellbore. Further, the flow regulating system may include a washpipe free feature used to set packer assemblies while still permitting fluid flow from the flow control device to flow into the tubular. These features (e.g., the flow control device and the washpipe free feature) are generally connected through complex housing, piping, and/or the like, which may be costly.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is a washpipe free feature of a lower completion assembly having various components for blocking fluid flow from a central bore of a tubular toward an annulus of the wellbore as the lower completion assembly is run-in-hole while still permitting fluid flow from the annulus to the central bore of the tubular. In particular, the washpipe free feature includes a piston held in a run-in position as the lower completion assembly is run-in-hole, which blocks a ball from traversing out of a nozzle chamber such that the ball may be moveable within the nozzle chamber of the washpipe free feature to seal the nozzle chamber and block fluid flow from a central bore of the tubular toward the annulus. Further, the washpipe free feature is configured to shift the piston once the lower completion assembly is positioned downhole such that the piston may move to an open position and allow the ball to move out of the nozzle chamber to permit open flow through the nozzle chamber, which may increase the efficiency of production operations.

Figure 1:
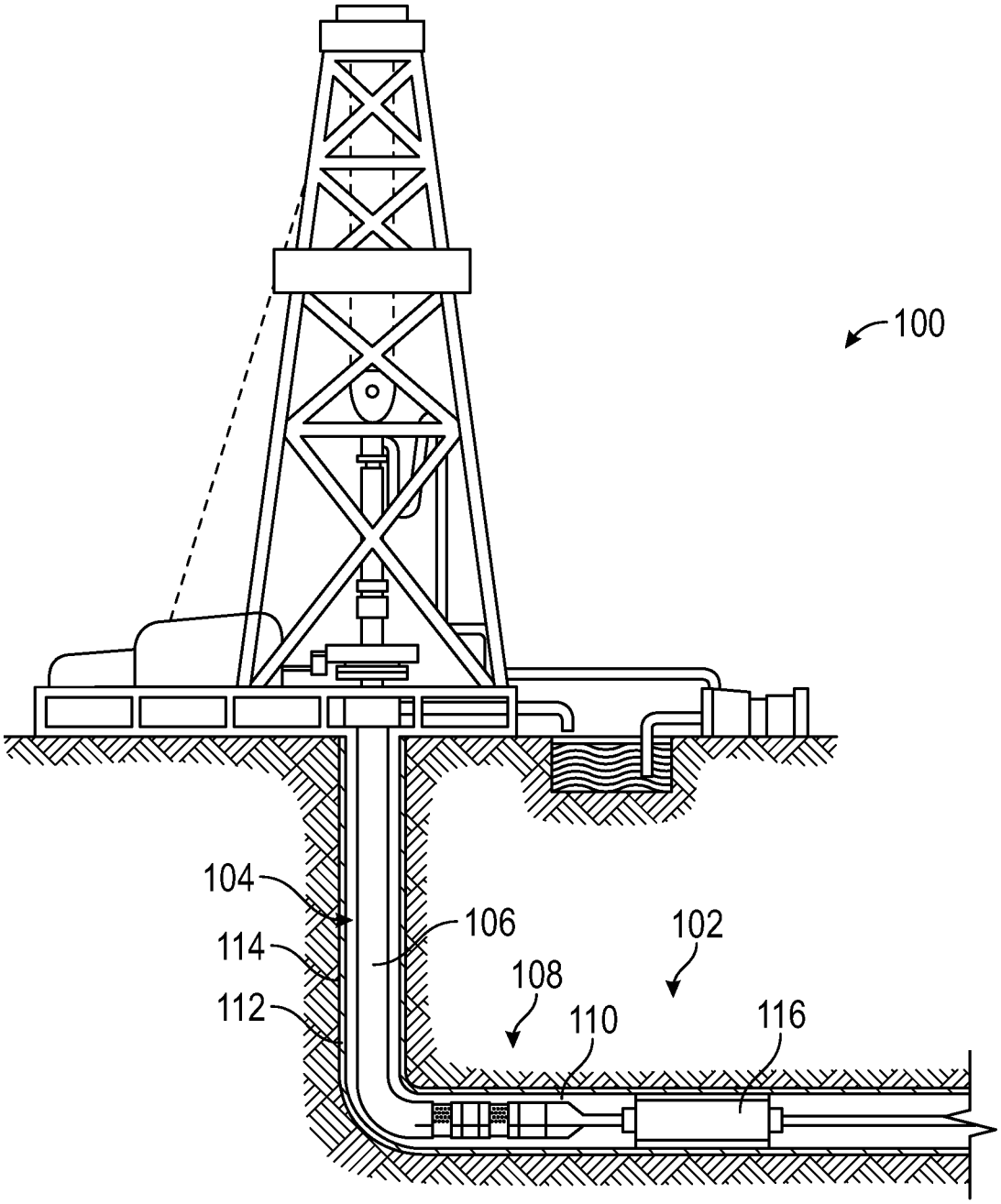
FIG. 1 illustrates a side elevation, partial cross-sectional view of an operational environment for a wellbore completion system, in accordance with some embodiments of the present disclosure.

FIG. 1 illustrates a side elevation, partial cross-sectional view of an operational environment for a wellbore completion system, in accordance with some embodiments of the present disclosure. As illustrated, the wellbore completion system 100 may include a lower completion assembly 102 that is run into a wellbore 104 via a downhole tubular 106 or other suitable conveyance. The lower completion assembly 102 includes at least one flow regulating system 108 for controlling fluid flow between an annulus 110 of the wellbore 104 and a central bore of the downhole tubular 106. As illustrated, the annulus 110 may be formed between the downhole tubular 106 and a casing 112 cemented to against a wellbore wall 114. In some embodiments, the annulus 110 may be formed between the downhole tubular 106 and the wellbore wall 114. Further, the lower completion assembly 102 may include a packer assembly 116, a latch subassembly, or any other suitable assembly.

As set forth in detail below, the at least one flow regulating system 108 may permit at least partial fluid flow from the annulus 110 to the downhole tubular 106 as the lower completion assembly 102 is run-in-hole. However, the at least one flow regulating system 108 may restrain fluid flow from the downhole tubular 106 to the annulus 110 as the lower completion assembly 102 is run-in-hole. Once the lower completion assembly 102 is positioned at a desired location in the wellbore 104, fluid may be pumped through the downhole tubular 106 toward the packer assembly 116. The pressure inside the tubular may increase to a setting pressure for actuating the packer assembly 116. Additionally, the setting pressure in the downhole tubular 106 may actuate the flow regulating system 108 such that the flow regulating system 108 allows open fluid flow between the annulus 110 and the downhole tubular 106. As such, fluids may flow openly through the flow regulating system 108 during production operations and/or injection.

Figure 2:
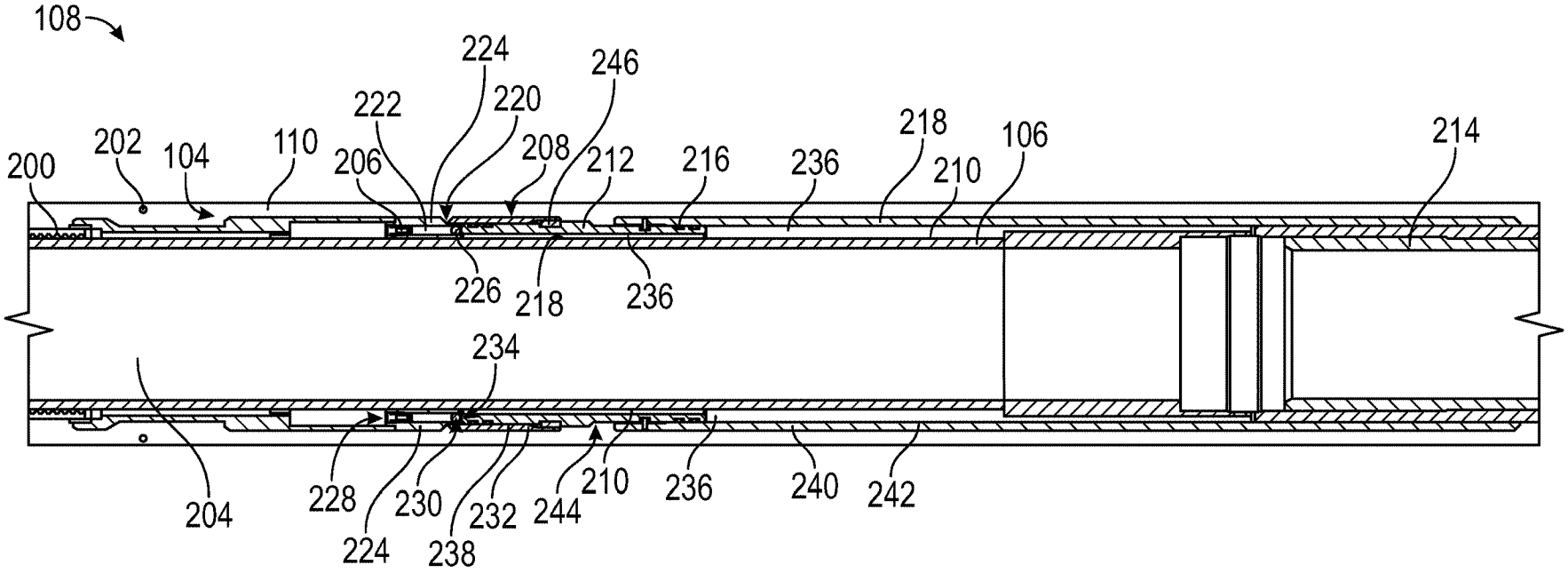
FIG. 2 illustrates a cross-sectional view of a flow regulating system coupled to a tubular that is run-in-hole during completion operations, in accordance with some embodiments of the present disclosure.

FIG. 2 illustrates a cross-sectional view of a flow regulating system coupled to a tubular that is run-in-hole during completion operations, in accordance with some embodiments of the present disclosure. The flow regulating system 108 comprises various components for controlling the fluid flow between the annulus 110 and the downhole tubular 106. For example, as illustrated, the flow regulating system 108 may include a plurality of screens 200 disposed about the downhole tubular 106. The screens 200 are configured to filter debris 202 (e.g., as gravel, sand, and other particulate matter) out of the fluid flowing into a central bore 204 of the downhole tubular 106 from the annulus 110, as debris 202 in the downhole tubular 106 may adversely affect production operations.

Further, the flow regulating system 108 may include a flow control device nozzle 206, disposed in a flow path between the plurality of screens 200 and the central bore 204 of the downhole tubular 106, as well as a washpipe free feature 208 disposed in the flow path between the flow control device nozzle 206 and the central bore 204 of the downhole tubular 106. The flow control device nozzle 206 may be an inflow control device or any other suitable flow control device. Moreover, the flow control device nozzle 206 and the washpipe free feature 208 may be secured to a radially outer surface 210 of the downhole tubular 106 (e.g., completion tubular). As illustrated, the flow control device nozzle 206 and at least a portion of the washpipe free feature 208 may be disposed within a housing 220 secured to the radially outer surface 210 of the downhole tubular 106. In particular, the flow control device nozzle 206 may be disposed within a nozzle chamber 222 formed in a nozzle portion 224 of the housing 220. Further, as set forth in greater detail below, a ball 226 of the washpipe free feature 208 may also be disposed within the nozzle chamber 222. The nozzle chamber 222 may extend axially through the nozzle portion 224 of the housing 220. A first end 228 of the nozzle chamber 222 may be in fluid communication with an annulus 110 of the wellbore 104, and a second end 230 of the nozzle chamber 222 may be in fluid communication with the central bore 204 of the downhole tubular 106.

The housing 220 may include various tubular portions disposed about the radially outer surface 210 of the downhole tubular 106. For example, as illustrated, the housing 220 may include the nozzle portion 224 secured to the radially outer surface 210 of the downhole tubular 106 and a piston portion 232 secured to the nozzle portion 224 of the housing 220. A first end 234 of the piston portion 232 may be secured proximate to the second end 230 of the nozzle chamber 222. Further, the piston portion 232 of the housing 220 may be radially offset from a radially outer surface 210 of the downhole tubular 106 to form a piston chamber 236. That is, at least a portion of the piston chamber 236 may be formed in the space between the radially outer surface 210 of the downhole tubular 106 and a radially inner surface 238 of the piston portion 232 of the housing 220.

The housing 220 may further include a tubular sleeve portion 240 disposed about the downhole tubular 106. The sleeve portion 240 may be disposed between the piston portion 232 of the housing 220 and a sliding sleeve door 214, which is set forth in greater detail below. As illustrated, the sleeve portion 240 of the housing 220 may also be radially offset from a radially outer surface 210 of the downhole tubular 106 to further define the piston chamber 236. That is, an additional portion of the piston chamber 236 may be formed in the space between the radially outer surface 210 of the downhole tubular 106 and the radially inner surface 242 of the sleeve portion 240 of the housing 220. Moreover, the sleeve portion 240 may be axially offset from the piston portion 232 to form a gap 244. As set forth in greater detail below, the gap 244 may be configured to receive a locking feature 246 of the flow regulating system 108. Alternatively, the sleeve portion 240 may be configured to contact the piston portion 232, and the piston portion 232, the sleeve portion 240, or some combination, thereof may instead include a recess configured to receive the locking feature 246.

Moreover, the washpipe free feature 208 may include a piston 212 disposed at least partially within the piston chamber. Further, the piston 212 may be disposed in a run-in position as the lower completion assembly 102 is run into the wellbore 104. In the run-in position, the washpipe free feature 208 is configured to permit fluid flow from the annulus 110 to the downhole tubular 106 while restraining fluid flow from the downhole tubular 106 to the annulus 110. However, after the lower completion assembly 102 is positioned at a desired location in the wellbore 104 and the pressure inside the tubular is increased to the setting pressure, a pressure differential in the washpipe free feature 208 may shift the piston 212 to an open position such that fluid may flow through the washpipe free feature 208 in both directions.

The washpipe free feature 208 may assist in setting the packer assembly. For example, the lower completion assembly 102 may be run-in-hole with the downhole tubular 106 plugged from below. As the lower completion assembly 102 is run-in-hole, wellbore fluid may flow into the tubular via the washpipe free feature 208. Because the downhole tubular 106 may be plugged from below and the downhole tubular 106 is filled with wellbore fluid via the washpipe free feature 208, the pressure in the downhole tubular 106 may be immediately increased to set the packer assembly once the lower completion assembly 102 is in the desired location in the wellbore 104.

Moreover, the flow regulating system 108 may include a sliding sleeve door 214 disposed in the flow path between the washpipe free feature 208 and the central bore 204 of the downhole tubular 106. The sliding sleeve door 214 has an open position and a closed position. As the lower completion assembly 102 is run-in-hole, the sliding sleeve door 214 is generally set in an open position such that fluid may flow between the annulus 110 and the downhole tubular 106. The sliding sleeve door 214 may be shifted between the open position to the closed position (e.g., to block fluid flow through the flow regulating system 108) using a tool that is lowered downhole to the lower completion assembly 102 via wireline, slickline or coil tubing. As such, shifting the sliding sleeve door 214 between the open position and the closed position may be time consuming. For at least this reason, the washpipe free feature 208 is configured to restrain fluid flow from the downhole tubular 106 to the annulus 110 in the run-in position. That is, the washpipe free feature 208 may restrain fluid flow from the downhole tubular 106 to the annulus 110 such that the sliding sleeve door 214 may remain open while the lower completion assembly 102 is run-in-hole and so production operations do not need to be delayed (e.g., to lower the tool) to shift the sliding sleeve door 214 to the closed position for setting the packer assembly 116. Accordingly, the sliding sleeve door 214 may remain open during the installation process and may instead be shifted between the open position and the closed position to control production flow during production operations.

Figure 3:
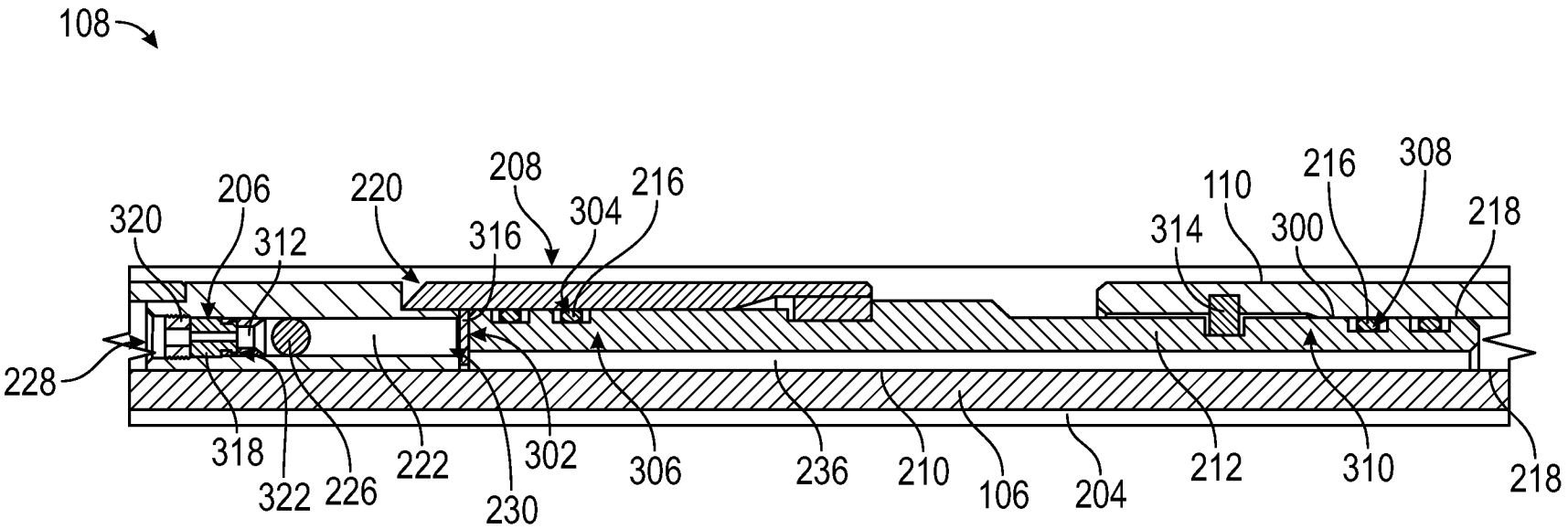
FIG. 3 illustrates a cross-sectional view of the flow regulating system with the piston of the washpipe free feature disposed in a run-in position, in accordance with some embodiments of the present disclosure.

FIG. 3 illustrates a cross-sectional view of the flow regulating system with the piston of the washpipe free feature disposed in a run-in position, in accordance with some embodiments of the present disclosure. As set forth above, the flow regulating system 108 includes a housing 220 that may be secured about the downhole tubular 106. In particular, the housing 220 may be secured about a radially outer surface 210 of the downhole tubular 106. The housing 220 includes the nozzle chamber 222 that may be in fluid communication with the annulus 110 and the central bore 204 of the downhole tubular 106. For example, the nozzle chamber 222 may extend axially through the housing 220 such that the first end 228 of the nozzle chamber 222 is in fluid communication with the annulus 110 of a wellbore 104 and a second end 230 of the nozzle chamber 222 is in fluid communication with a piston chamber 236. That is, the nozzle chamber 222 may be connected to the piston chamber 236 via at the second end 230 of the nozzle chamber 222 such that fluid may flow between the nozzle chamber 222 and the piston chamber 236.

Moreover, the housing 220 may be configured house the flow control device nozzle 206 that is in fluid communication with nozzle chamber 222. As illustrated, the flow control device nozzle 206 may be disposed within the nozzle chamber 222 to control a fluid flow rate through the nozzle chamber 222. As the flow control device nozzle 206 may be disposed within the nozzle chamber 222, the flow control device nozzle 206 may be in fluid communication with an annulus 110 of the wellbore 104 (e.g., referring to FIG. 1). In particular, the flow control device nozzle 206 may be in fluid communication with the plurality of screens 200 (shown in FIG. 2), which are in direct fluid communication with the annulus 110. Additionally, the flow control device nozzle 206 may be in fluid communication with the central bore 204 of the downhole tubular 106 via the piston chamber 236, which is in fluid communication with a central bore 204 of tubular 106 (shown in FIG. 2). Indeed, the piston chamber 236 may extend through any suitable portion of the housing 220 as to be in fluid communication with the central bore 204 of the downhole tubular 106. Moreover, as set forth above, the piston chamber 236 may be in fluid communication with the sliding sleeve door 214 (shown in FIG. 2), via another flow path extending between the sliding sleeve door 214 and piston chamber 236, and the sliding sleeve door 214 may be in direct fluid communication with the downhole tubular 106 (shown in FIG. 2).

Moreover, as set forth above, the washpipe free feature 208 includes the piston 212 that is disposed within piston chamber 236. As illustrated, the piston 212 may include at least one piston seal 216 disposed about a radially outer surface 300 of the piston 212 to seal the piston 212 against the inner surface 218 of piston chamber 236. In the run-in position, the piston 212 may be at least partially disposed within nozzle chamber 222, about flush, or flush with the second end 230 of the nozzle chamber 222. However, a proximal end 302 of the piston 212 may be angled such that the proximal end 302 only partially blocks fluid flow through the second end 230 of the nozzle chamber 222.

As illustrated, in the run-in position, the washpipe free feature 208 may further include the ball 226 disposed within the nozzle chamber 222. Indeed, in the run-in position, the piston 212 may be configured to prevent the ball 226 from exiting the nozzle chamber 222 and moving into piston chamber 236. In the illustrated embodiment, the piston 212 is secured in the run-in position. However, as set forth in detail below, the piston 212 is slidable from the run-in position to an open position (shown in FIGS. 4 & 5). The piston 212 may be slidable at least in part due to a first group of piston seals 304 (e.g., O-rings) disposed about a proximal side 306 of the piston 212 having larger outer diameters (OD) than a second group of piston seals 308 that are disposed about a distal side 310 of the piston 212 with respect to the nozzle chamber 222. As pressure builds within nozzle chamber 222 and/or piston chamber 236, a net force may be applied to piston 212 in an axial direction to drive the piston 212 to slide toward the open position. Such pressure and/or fluid flow in the nozzle chamber 222 and/or piston chamber 236 may also drive the ball 226 to move within nozzle chamber 222 in response to fluid flow through nozzle chamber 222. For example, as set forth in greater detail below, in response to pressuring up the downhole tubular 106, the ball 226 may be driven into a ball seat 312 of the flow control device nozzle 206. That is, with the ball 226 disposed in the nozzle chamber 222, fluid flowing from the central bore 204 of the downhole tubular 106 toward the annulus 110 may drive the ball 226 into the ball seat 312. Further, the interface between the ball 226 and the ball seat 312 may block fluid flow through the nozzle chamber 222, which may cause pressure to build in the nozzle chamber 222, the piston chamber 236, and the central bore 204 of the downhole tubular 106.

In response to the pressure reaching a predetermined pressure in the piston chamber 236, the piston 212 may shift from the run-in position to an open position. That is, at the predetermined pressure, the driving force on the piston 212 via the pressure may shear at least one shear feature 314 securing the piston 212 to the housing 220. In response to the at least one shear feature 314 shearing, the piston 212 may freely move from the run-in position to the open position. In the open position, fluid flowing from annulus 110 toward the central bore 204 of tubular 106 may drive the ball 226 from the nozzle chamber 222 and into the piston chamber 236. As the piston 212 slides toward the open position, the ball 226 may traverse out of nozzle chamber 222 and into piston chamber 236, which may allow for unobstructed fluid communication between nozzle chamber 222 and piston chamber 236.

Such fluid flow may also drive the ball 226 toward a magnet disposed within piston chamber 236. The ball 226 may comprise a ferromagnetic material (e.g., ferromagnetic metal) such that the magnet may hold the ball 226 once the ball 226 comes in contact with the magnet. The magnet may be secured to the inner surface 218 of piston chamber 236 via at least one fastener (e.g., screw, pin, adhesive). Alternatively, the magnet may be press-fit, welded, or otherwise secured within piston chamber 236. Moreover, the magnet may include any suitable permanent magnet or electromagnet. For example, the magnet may comprise a rare earth metal magnet (e.g., or samarium cobalt, neodymium, etc.), which provides the benefit of maintaining a magnetic field without an external power source. Further, the magnet may be coated or otherwise isolated from the fluid traversing through piston chamber 236. In some embodiments, the magnet may comprise a material that is not chemically compatible with the fluids in piston chamber 236. As such, the magnet may be coated or otherwise isolated to prevent undesired chemical reactions between the magnet and the fluid. It should be further noted that a magnet may not be utilized to prevent ball 226 from traversing back to nozzle chamber 222. Alternatively, the ball 226 may disintegrate or a flexible tab 316 may be utilized to prevent ball 226 from traversing back to nozzle chamber 222. This may allow for ball 226 to traverse out of nozzle chamber 222 and prevent ball 226 from traversing back into the nozzle chamber 222.

Further, as set forth above, the washpipe free feature 208 may further include the at least one shear feature 314 configured to restrain sliding of the piston 212 and hold the piston 212 in the run-in position. The at least one shear feature 314 may include at least one shear screw, at least one shear pin, at least one shear ring, or any suitable shear mechanism. In some embodiments, the shear feature 314 may include a combination of shear mechanisms. Moreover, in the run-in position, a distal end of piston 212 is configured to interface with the ball 226 to block the ball 226 from traversing to piston chamber 236. As illustrated, the proximal end 302 of piston 212 may extend through at least a part of nozzle chamber 222 to interface with the ball 226 in the run-in position.

As illustrated, the washpipe free feature 208 is in the run-in position and fluid may be flowing from the downhole tubular 106 toward the annulus 110 (e.g., referring to FIG. 1). That is, fluid is flowing from piston chamber 236 toward nozzle chamber 222. As such, the ball 226 may be driven toward the ball seat 312. As illustrated, the flow control device nozzle 206 may include the ball seat 312 configured to receive the ball 226. That is, the ball seat 312 and flow control device nozzle 206 may be a singular part or one or more parts that are assembled together to form a singular device. In particular, the flow control device nozzle 206 may include a nozzle body 318, an adjustable threaded portion 320, and the ball seat 312, which may be formed about a distal end 322 of the nozzle body 318. The nozzle body 318 may be formed of a hardened material to resist erosion, whereas the ball seat 312 may be formed of a softer material to facilitate a fluid seal between ball 226 and ball seat 312. However, the nozzle body 318 and the ball seat 312 may include any suitable materials. Further, the ball seat 312 may include a tapered shape configured to receive the ball 226. However, the ball seat 312 may include any suitable shape configured to form a seal in response to the ball 226 interfacing with the ball seat 312.

Moreover, after the lower completion assembly 102 (shown in FIG. 1) is positioned at a desired location in the wellbore 104 (shown in FIG. 1), the pressure inside the downhole tubular 106 may be increased to the setting pressure for actuating the packer assembly 116 (shown in FIG. 1). However, fluid flowing through nozzle chamber 222 toward the annulus 110 may act as a pressure drop that may increase a needed fluid flow to achieve the setting pressure. As such, preventing fluid flow from nozzle chamber 222 toward the annulus 110, via blocking nozzle chamber 222 with the ball 226, may assist in raising the pressure in the downhole tubular 106 to the setting pressure. Further, preventing fluid flow from nozzle chamber 222 toward annulus 110 may raise the pressure in piston chamber 236 to a threshold pressure for shifting the piston 212 from the run-in position to the open position (shown in FIGS. 4-5).

Figure 4:
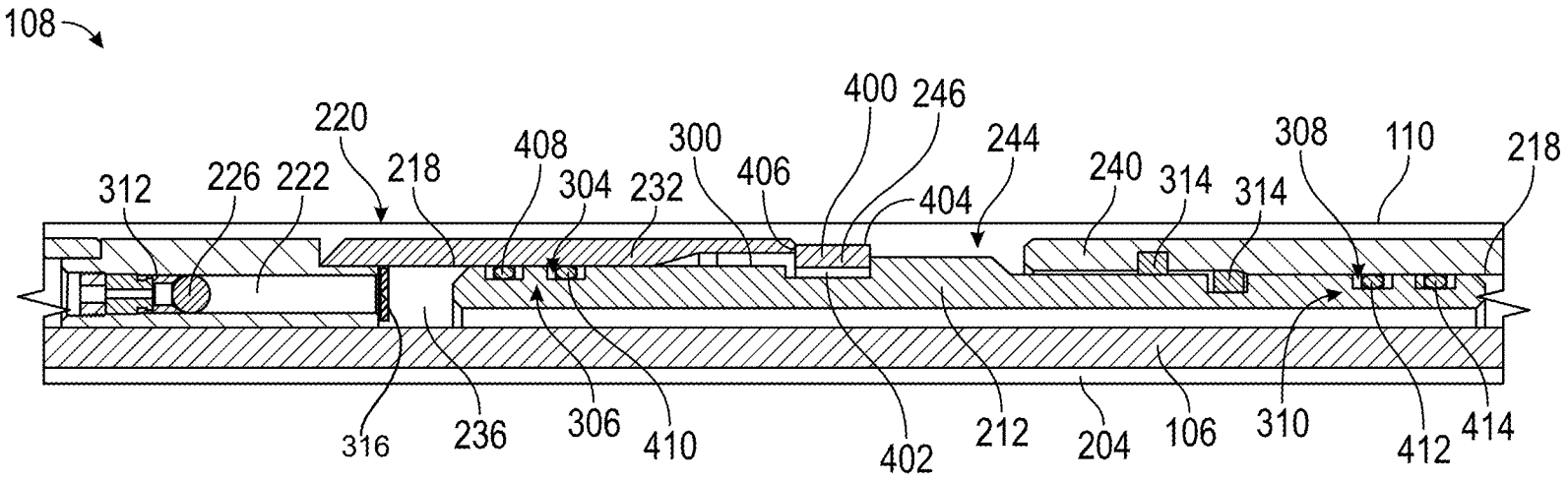
FIG. 4 illustrates a cross-sectional view of the flow regulating system with the piston of the washpipe free feature disposed in an open position, in accordance with some embodiments of the present disclosure.

FIG. 4 illustrates a cross-sectional view of the flow regulating system with the piston of the washpipe free feature disposed in an open position, in accordance with some embodiments of the present disclosure. As set forth above, the at least one shear feature 314 (e.g., shear screw, shear pin, shear ring, etc.) is configured to hold the piston 212 in the run-in position (shown in FIG. 3). However, in response to flow fluid from the central bore 204 of the downhole tubular 106 toward the annulus 110, the ball 226 may be driven to sit over a ball seat 312 in response to the fluid flow from the annulus 110 to the downhole tubular 106 and plug the nozzle chamber 222 to prevent fluid flow toward the annulus 110. With nozzle chamber 222 blocked, the pressure inside piston chamber 236 may increase as the pressure inside the downhole tubular 106 is increased to the setting pressure for actuating the packer assembly 116 (shown in FIG. 1). In response to the pressure in piston chamber 236 increasing to the predetermined threshold pressure, the piston 212 is configured to shear at least one shear feature 314 and slide to the open position.

As illustrated, the piston 212 is disposed in the open position. Further, the flow regulating system 108 may include the locking feature 246 configured to hold the piston 212 in the open position. As illustrated, the locking feature 246 may comprise a snap ring 400 disposed about a piston slot 402 formed in the radially outer surface 300 of the piston 212. However, the snap ring 400 may be disposed in any suitable position along piston 212. In the run-in position, the snap ring 400 may be held within the piston slot 402 via contact between a radially outer surface 404 of the snap ring 400 and the housing 220. The housing 220 may form at least a portion of the inner surface 218 defining the piston chamber 236. Moreover, as illustrated, the housing may include the gap 244, borehole, recess, or any suitable feature for permitting expansion of the snap ring 400. As illustrated, the gap 244 may be formed between adjacent portions (e.g., the piston portion 232 and the sleeve portion 240) of the housing 220. As the piston 212 slides from the run-in position toward the open position, the snap ring 400 may axially align with the gap 244 such that the snap ring 400 may expand radially outward at least partially into the gap 244. That is, as the piston 212 slides from the run-in position into the open position, the snap ring 400 may expand into the gap 244 to secure the piston 212 in the open position. In particular, with the snap ring 400 expanded, an interface between the snap ring 400 and a sidewall 406 of the gap 244 (e.g., the piston portion 232), as well as an interface between the snap ring 400 and the piston slot 402 of the piston 212, may hold the piston 212 in the open position.

Alternatively, the housing 220 may include a recess formed in piston portion 232 and/or the sleeve portion 240 of the housing 220. The recess may be configured to receive the snap ring 400. In particular, as the piston 212 slides from the run-in position toward the open position, the snap ring 400 may axially align with the recess such that the snap ring 400 may expand radially outward at least partially into the recess.

Moreover, the locking feature 246 may include any suitable feature configured to secure the piston 212 in the open position. For example, the locking feature 246 may alternatively include a j-slot formed in the housing 220. The piston 212 may include a corresponding protrusion extending radially outward the radially outer surface 300 of the piston 212. The protrusion may interface with the j-slot to secure the piston 212 in the open position. That is, once the piston 212 moves to the open position, the geometry of the j-slot may restrain the protrusion from moving toward nozzle chamber 222, which may hold the piston 212 in the open position.

Further, the piston 212 may be configured to seal a portion of the piston chamber 236. As illustrated, the gap 244 in between adjacent portions of the housing 220 may be in fluid communication with the annulus 110 of the wellbore 104. To maintain a desired pressure within the piston chamber 236, the piston 212 may be configured to seal the gap 244 from the piston chamber 236. As illustrated, the piston 212 may include a plurality of seals secured about a radially outer surface 300 of the piston 212. In particular, the piston 212 may include the first group of piston seals 304 (e.g., a first piston seal 408 and a second piston seal 410) disposed at on the proximal side 306 of the piston 212 and a second group of piston seals 308 (e.g., a third piston seal 412 and a fourth piston seal 414) disposed on the distal side 310 of the piston 212. However, the piston 212 may include any suitable number of seals. The first group of piston seals 304 may be configured to form seals between the piston 212 and the housing 220 uphole from the gap 244. Additionally, the second group of piston seals 308 may be configured to form seals between the piston 212 and the housing 220 downhole from the gap 244 such that the gap 244 may be sealed from the piston chamber 236.

Figure 5:
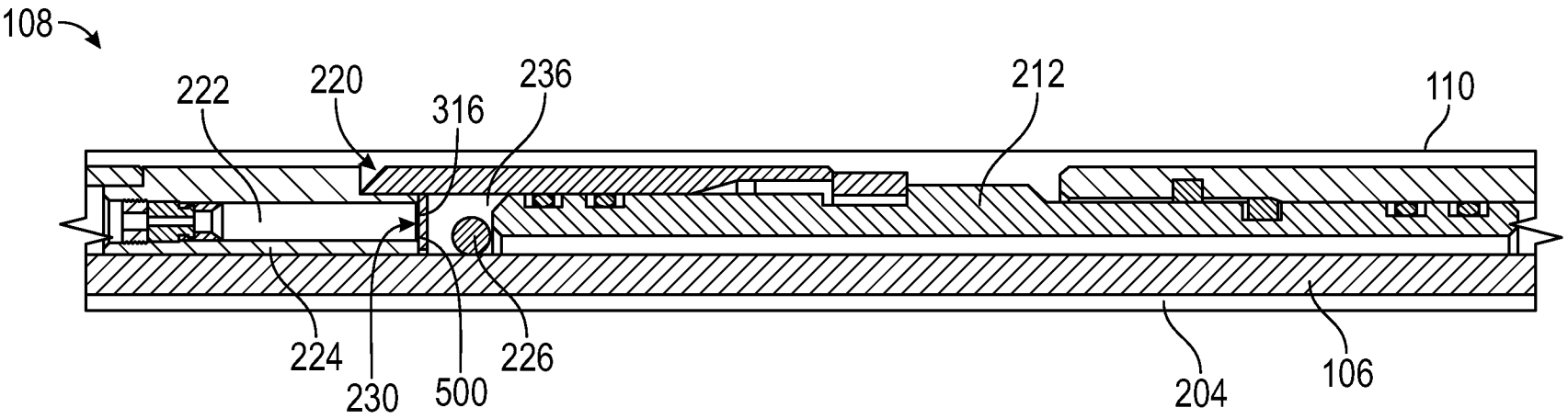
FIG. 5 illustrates a cross-sectional view of the piston in an open position and the ball ejected from the nozzle chamber, in accordance with some embodiments of the present disclosure.

FIG. 5 illustrates a cross-sectional view of the piston in an open position and the ball ejected from the nozzle chamber, in accordance with some embodiments of the present disclosure. The ball 226 may traverse out of nozzle chamber 222 in response to flow of production fluid through the nozzle chamber 222 toward the central bore 204 of the downhole tubular 106. With the piston 212 in the open position, the distal end of the piston 212 may no longer block the ball 226 from traversing into piston chamber 236. As set forth above, the ball 226 may contact the magnet in the piston chamber 236 to hold the ball 226 out of the nozzle chamber 222. Indeed, fluid flow through the nozzle chamber 222 may drive the ball 226 into contact with the magnet. As the ball 226 comprises ferromagnetic metal, the magnet may hold the ball 226 out of the flow path between the nozzle chamber 222 and piston chamber 236 of the washpipe free feature 208. For example, production fluid may flow through nozzle chamber 222 from flow control device nozzle 206 toward piston chamber 236. With the ball 226 within piston chamber 236 and may be held by a magnet, the production fluid may flow through nozzle chamber 222 to piston chamber 236 uninhibited by the ball 226, which may increase the efficiency of production operations, as well as allow injection from the downhole tubular 106 to the annulus 110.

However, the flow regulating system 108 may include any suitable feature for holding the ball 226 out of the nozzle chamber 222 in response to the piston 212 moving from the run-in position to the open position. For example, the flow regulating system 108 may alternatively, or additionally, include a flexible tab 316 secured to the housing 220 over the second end 230 of the nozzle chamber 222. The flexible tab 316 may be configured to deflect in response to contact from the ball 226 moving from the nozzle chamber 222 toward the piston chamber 236. However, an interface between a lower end 500 of the flexible tab 316 and the nozzle portion 224 of the housing 220 may restrain the flexible tab 316 from deflecting to allow the ball 226 to move from the piston chamber 236 into the nozzle chamber 222. Accordingly, the flexible tab 316 may hold the ball 226 out of the nozzle chamber 222 in response to the piston 212 moving from the run-in position to the open position. Alternatively, the ball 226 may include a dissolvable material such that the ball 226 may dissolve at a predetermined time, which may be after the piston 212 has moved from the run-in position to the open position.

Figure 6:
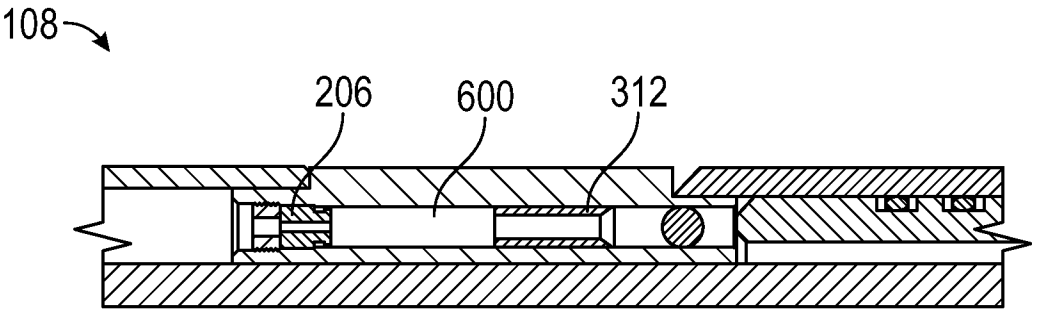
FIG. 6 illustrates a cross-sectional view of the flow regulating system 108 having a ball seat feature separate from the flow control device nozzle, in accordance with some embodiments of the present disclosure.

FIG. 6 illustrates a cross-sectional view of the flow regulating system 108 having a ball seat feature separate from the flow control device nozzle, in accordance with some embodiments of the present disclosure. As illustrated, the ball seat 312 may be disposed on a separate retainer in series with flow control device nozzle 206. The ball seat 312 may be in fluid connection with flow control device nozzle 206 via a connection chamber 600 formed within the nozzle chamber 222. The connection chamber 600 be any suitable shape, length, and width to allow for the flow of fluid from ball seat 312 to flow control device nozzle 206. Alternatively, the nozzle and ball seat could be enclosed in two separate housings.

Accordingly, the present disclosure may provide a flow control device nozzle and at least a portion of a washpipe free feature disposed within a nozzle chamber of a housing. The washpipe free feature configured to block fluid flow from a central bore of a tubular toward an annulus of the wellbore as the lower completion assembly is run-in-hole while still permitting fluid flow from the annulus to the central bore of the tubular in a run-in position. The washpipe free feature may include any of the various features disclosed herein, including one or more of the following statements.

Statement 1. A downhole system comprising: a housing disposed about a downhole tubular, wherein the housing includes a nozzle chamber in fluid communication with an annulus of a wellbore; a flow control device nozzle disposed within the nozzle chamber and configured to control a fluid flow rate through the nozzle chamber; a ball disposed within the nozzle chamber, wherein the ball is moveable to plug the nozzle chamber in response to fluid flow from a central bore of the downhole tubular toward the annulus; a piston chamber in fluid communication with the nozzle chamber and the central bore of a downhole tubular; and a piston disposed within the piston chamber, wherein the piston is slidable between a run-in position and an open position, wherein the piston blocks the ball from traversing into the piston chamber in the run-in position.

Statement 2. The downhole system of statement 1, further comprising at least one shear feature configured to hold the piston in the run-in position.

Statement 3. The downhole system of statement 1 or statement 2, wherein the at least one shear feature is configured to shear in response to a predetermined threshold pressure in the tubular, and wherein the predetermined threshold pressure drives the piston to slide from the run-in position to the open position.

Statement 4. The downhole system of any preceding statement, further comprising at least one seal disposed about the piston to seal the piston against an inner surface of a piston portion of the housing.

Statement 5. The downhole system of any preceding statement, further comprising a locking feature configured to secure the piston in the open position, wherein the locking feature comprises a snap ring disposed about a slot formed in a radially outer surface of the piston, and wherein the snap ring is configured to expand to secure the piston in the open position.

Statement 6. The downhole system of any preceding statement, wherein the ball is configured to traverse into the piston chamber in response to the piston moving to the open position and fluid flow from the annulus toward the central bore of the downhole tubular.

Statement 7. The downhole system of any preceding statement, further comprising a flexible tab disposed at a second end of the nozzle chamber, wherein the flexible tab is configured in deflect to permit the ball to move from the nozzle chamber to the piston chamber, and wherein the flexible tab is configured to block the ball from moving from the piston chamber into the nozzle chamber.

Statement 8. The downhole system of any preceding statement, further comprising a magnet configured to secure the ball within the piston chamber to prevent the ball from blocking flow through the nozzle chamber.

Statement 9. The downhole system of any preceding statement, wherein the magnet comprises a rare earth metal magnet.

Statement 10. The downhole system of any preceding statement, wherein the flow control device nozzle includes a nozzle body and a ball seat formed at a distal end of the nozzle body, and wherein the ball seat is configured to receive the ball seat to plug the nozzle chamber in response to fluid flow from the central bore of the downhole tubular toward the annulus.

Statement 11. The downhole system of any preceding statement, wherein the flow control device nozzle is adjustable.

Statement 12. The downhole system of any preceding statement, further comprising a plurality of screens to filter debris out of fluids flowing through the screens from the annulus of a wellbore toward the central bore of the downhole tubular.

Statement 13. The downhole system of any preceding statement, further comprising a sliding sleeve door disposed in a flow path between the piston chamber and the central bore of the downhole tubular, wherein the sliding sleeve door has an open position and a closed position, and wherein the sliding sleeve door is set in the open position while run-in-hole to permit fluid flow between the annulus and the central bore of the downhole tubular.

Statement 14. A downhole system comprising: a housing disposed about a downhole tubular, wherein the housing includes a nozzle chamber extending axially through a nozzle portion of the housing, wherein a first end of the nozzle chamber is in fluid communication with an annulus of a wellbore; a flow control device nozzle disposed within the nozzle chamber and configured to control a fluid flow rate through the nozzle chamber, wherein the flow control device nozzle includes a nozzle body and a ball seat formed at a distal end of the nozzle body; a ball disposed within the nozzle chamber, wherein the ball is moveable to interface with the ball seat to plug the nozzle chamber in response to fluid flow from a central bore of the downhole tubular toward the annulus; a piston chamber in fluid communication with a second end of the nozzle chamber and the central bore of a downhole tubular; and a piston disposed within the piston chamber, wherein the piston is slidable between a run-in position and an open position, wherein the piston blocks the ball from traversing into the piston chamber in the run-in position.

Statement 15. The downhole system of statement 14, wherein a piston portion of the housing includes at least one tubular feature, wherein a first end of the piston portion is secured to the nozzle portion of the housing, and wherein the piston portion of the housing is radially offset from a radially outer surface of the downhole tubular, wherein the piston chamber is formed between the radially outer surface of the downhole tubular and a radially inner surface of the piston portion of the housing.

Statement 16. The downhole system of statement 14 or statement 15, wherein a sleeve portion of the housing is disposed between the piston portion and a sliding sleeve door, wherein the sliding sleeve door is disposed in a flow path between the piston chamber and the central bore of the tubular, wherein the sliding sleeve door has an open position and a closed position, and wherein the sliding sleeve door is set in the open position while run-in-hole to permit fluid flow between the annulus and the central bore of the downhole tubular.

Statement 17. The downhole system of any of statements 14-16, further comprising a locking feature secured to the piston and a recess formed in the piston portion of the housing, wherein the locking feature is configured to expand into a gap formed between the piston portion and the sleeve portion of the housing to secure the piston in the open position.

Statement 18. A downhole system comprising: a housing disposed about a downhole tubular, wherein the housing includes a nozzle chamber extending axially through a nozzle portion of the housing, wherein a first end of the nozzle chamber is in fluid communication with an annulus of a wellbore; a flow control device nozzle disposed within the nozzle chamber and configured to control a fluid flow rate through the nozzle chamber, wherein the flow control device nozzle includes a nozzle body and a ball seat formed at a distal end of the nozzle body; a ball disposed within the nozzle chamber, wherein the ball is moveable to interface with the ball seat to plug the nozzle chamber in response to fluid flow from a central bore of the downhole tubular toward the annulus; a piston chamber in fluid communication with the nozzle chamber and the central bore of a downhole tubular; a piston disposed within the piston chamber, wherein the piston is slidable between a run-in position and an open position, wherein the piston blocks the ball from traversing into the piston chamber in the run-in position; at least one shear feature configured to hold the piston in the run-in position, wherein the at least one shear feature is configured to shear in response to a predetermined threshold pressure, wherein a pressure differential between the tubular and the annulus drives the piston slides from the run-in position to the open position, wherein the ball is configured to move into the piston chamber in response to the piston sliding to the open position to clear a flow path between the piston chamber and the central bore of the downhole tubular; and a locking feature configured to secure the piston in the open position.

Statement 19. The downhole system of statement 18, wherein the locking feature comprises a snap ring disposed about a slot formed in a radially outer surface of the piston, wherein the snap ring is configured to expand to secure the piston in the open position.

Statement 20. The downhole system of statement 18, wherein the locking feature comprises a j-slot formed in an inner surface of the housing, wherein the piston comprises a protrusion extending radially outward from a proximal end of the piston, and wherein the protrusion is configured to interface with the j-slot to secure the piston in the open position.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole system comprising:

a housing disposed about a downhole tubular, wherein the housing includes a nozzle chamber in fluid communication with an annulus of a wellbore;

a flow control device nozzle disposed within the nozzle chamber and configured to control a fluid flow rate through the nozzle chamber;

a ball disposed within the nozzle chamber, wherein the ball is moveable to plug the nozzle chamber in response to fluid flow from a central bore of the downhole tubular toward the annulus;

a piston chamber in fluid communication with the nozzle chamber and the central bore of the downhole tubular, wherein the piston chamber is formed at least between a radially outer surface of the downhole tubular and a radially inner surface of a piston portion of the housing; and an annular piston disposed about the downhole tubular and within the piston chamber, wherein the angular piston is slidable between a run-in position and an open position, wherein the annular piston blocks the ball from traversing into the piston chamber in the run-in position, wherein a radially outer surface of the annular piston is sealed against the radially inner surface of the piston portion of the housing, and wherein fluid passing through the piston chamber flows along a central bore of the annular piston between a radially inner surface of the annular piston and the radially outer surface of the downhole tubular.

2. The downhole system of claim 1, further comprising at least one shear feature configured to hold the annular piston in the run-in position.

3. The downhole system of claim 2, wherein the at least one shear feature is configured to shear in response to a predetermined threshold pressure in the tubular, and wherein the predetermined threshold pressure drives the annular piston to slide from the run-in position to the open position.

4. The downhole system of claim 1, further comprising at least one seal disposed about the annular piston to seal the annular piston against an inner surface of the piston portion of the housing.

5. The downhole system of claim 1, further comprising a locking feature configured to secure the annular piston in the open position, wherein the locking feature comprises a snap ring disposed about a slot formed in the radially outer surface of the annular piston, and wherein the snap ring is configured to expand to secure the annular piston in the open position.

6. The downhole system of claim 1, wherein the ball is configured to traverse into the piston chamber in response to the annular piston moving to the open position and fluid flow from the annulus toward the central bore of the downhole tubular.

7. A downhole system comprising:

a housing disposed about a downhole tubular, wherein the housing includes a nozzle chamber in fluid communication with an annulus of a wellbore;

a flow control device nozzle disposed within the nozzle chamber and configured to control a fluid flow rate through the nozzle chamber, a ball disposed within the nozzle chamber, wherein the ball is moveable to plug the nozzle chamber in response to fluid flow from a central bore of the downhole tubular toward the annulus;

a piston chamber in fluid communication with the nozzle chamber and the central bore of a downhole tubular; and an angular piston disposed about the downhole tubular and within the piston chamber, wherein the piston is slidable between a run-in position and an open position, wherein the piston blocks the ball from traversing into the piston chamber in the run-in position; and a flexible tab disposed at a second end of the nozzle chamber, wherein the flexible tab is configured in deflect to permit the ball to move from the nozzle chamber to the piston chamber, and wherein the flexible tab is configured to block the ball from moving from the piston chamber into the nozzle chamber.

8. The downhole system of claim 1, further comprising a magnet configured to secure the ball within the piston chamber to prevent the ball from blocking flow through the nozzle chamber.

9. The downhole system of claim 8, wherein the magnet comprises a rare earth metal magnet.

10. The downhole system of claim 1, wherein the flow control device nozzle includes a nozzle body and a ball seat formed at a distal end of the nozzle body, and wherein the ball seat is configured to receive the ball to plug the nozzle chamber in response to fluid flow from the central bore of the downhole tubular toward the annulus.

11. The downhole system of claim 1, wherein the flow control device nozzle is adjustable.

12. The downhole system of claim 1, further comprising a plurality of screens to filter debris out of fluids flowing through the screens from the annulus of the wellbore toward the central bore of the downhole tubular.

13. A downhole system comprising:

a housing disposed about a downhole tubular, wherein the housing includes a nozzle chamber in fluid communication with an annulus of a wellbore;

a flow control device nozzle disposed within the nozzle chamber and configured to control a fluid flow rate through the nozzle chamber;

a ball disposed within the nozzle chamber, wherein the ball is moveable to plug the nozzle chamber in response to fluid flow from a central bore of the downhole tubular toward the annulus;

a piston chamber in fluid communication with the nozzle chamber and the central bore of a downhole tubular; and an annular piston disposed about the downhole tubular and within the piston chamber, wherein the piston is slidable between a run-in position and an open position, wherein the piston blocks the ball from traversing into the piston chamber in the run-in position; and a sliding sleeve door disposed along a flow path between the piston chamber and the central bore of the downhole tubular, wherein the sliding sleeve door has an open position and a closed position, and wherein the sliding sleeve door is set in the open position while run-in-hole to permit fluid flow between the annulus and the central bore of the downhole tubular.

14. A downhole system comprising:

a housing disposed about a downhole tubular, wherein the housing includes a nozzle chamber extending axially through a nozzle portion of the housing, wherein a first end of the nozzle chamber is in fluid communication with an annulus of a wellbore, wherein the housing further includes a tubular piston portion and tubular sleeve portion, and wherein the housing includes a gap formed axially between the tubular piston portion and the tubular sleeve portion;

a flow control device nozzle disposed within the nozzle chamber and configured to control a fluid flow rate through the nozzle chamber, wherein the flow control device nozzle includes a nozzle body and a ball seat formed at a distal end of the nozzle body;

a ball disposed within the nozzle chamber, wherein the ball is moveable to interface with the ball seat to plug the nozzle chamber in response to fluid flow from a central bore of the downhole tubular toward the annulus;

a piston chamber in fluid communication with a second end of the nozzle chamber and the central bore of the downhole tubular, wherein the piston chamber is formed at least between a radially outer surface of the downhole tubular and a radially inner surface of a piston portion of the housing; and an angular piston disposed within the piston chamber, wherein the annular piston is slidable between a run-in position and an open position, wherein the annular piston blocks the ball from traversing into the piston chamber in the run-in position, wherein a radially outer surface of the annular piston is sealed against the radially inner surface of the piston portion of the housing, and wherein fluid passing through the piston chamber flows along a central bore of the annular piston between a radially inner surface of the annular piston and the radially outer surface of the downhole tubular;

a locking feature secured to the annular piston, wherein the locking feature is configured to expand into a gap formed between the tubular piston portion and the tubular sleeve portion of the housing to secure the annular piston in the open position.

15. The downhole system of claim 14, wherein a first end of the tubular piston portion is secured to the nozzle portion of the housing, and wherein the tubular piston portion of the housing is radially offset from a radially outer surface of the downhole tubular, wherein the piston chamber is formed between the radially outer surface of the downhole tubular and a radially inner surface of the tubular piston portion of the housing.

16. The downhole system of claim 15, further comprising a sliding sleeve door is disposed along a flow path between the piston chamber and the central bore of the tubular, wherein the sliding sleeve door has an open position and a closed position, and wherein the sliding sleeve door is set in the open position while run-in-hole to permit fluid flow between the annulus and the central bore of the downhole tubular.

17. A downhole system comprising:

a housing disposed about a downhole tubular, wherein the housing includes a nozzle chamber extending axially through a nozzle portion of the housing, wherein a first end of the nozzle chamber is in fluid communication with an annulus of a wellbore;

a flow control device nozzle disposed within the nozzle chamber and configured to control a fluid flow rate through the nozzle chamber, wherein the flow control device nozzle includes a nozzle body and a ball seat formed at a distal end of the nozzle body;

a ball disposed within the nozzle chamber, wherein the ball is moveable to interface with the ball seat to plug the nozzle chamber in response to fluid flow from a central bore of the downhole tubular toward the annulus;

a piston chamber in fluid communication with the nozzle chamber and the central bore of a downhole tubular;

a piston disposed within the piston chamber, wherein the piston is slidable between a run-in position and an open position, wherein the piston blocks the ball from traversing into the piston chamber in the run-in position;

at least one shear feature configured to hold the piston in the run-in position, wherein the at least one shear feature is configured to shear in response to a predetermined threshold pressure, wherein a pressure differential between the tubular and the annulus drives the piston slides from the run-in position to the open position, wherein the ball is configured to move into the piston chamber in response to the piston sliding to the open position to clear a flow path between the piston chamber and the central bore of the downhole tubular; and a locking feature configured to secure the piston in the open position, wherein the locking feature comprises a j-slot formed in an inner surface of the housing, wherein the piston comprises a protrusion extending radially outward from a proximal end of the piston, and wherein the protrusion is configured to interface with the j-slot to secure the piston in the open position.

* * * * *